United States Patent [19]

Manderscheid

[11] 3,955,363

[45] May 11, 1976

[54] COMBUSTION ENGINE WITH AT LEAST ONE EXHAUST GAS CLEANING ARRANGEMENT

[75] Inventor: Peter Manderscheid, Wolfsburg, Germany

[73] Assignee: Volkswagenwerk Aktiengesellschaft, Wolfsburg, Germany

[22] Filed: Nov. 29, 1974

[21] Appl. No.: 528,256

Related U.S. Application Data

[63] Continuation of Ser. No. 262,006, June 12, 1972, abandoned.

[30] Foreign Application Priority Data

June 11, 1971 Germany ..... 2128988

[52] U.S. Cl. ..... 60/277; 60/285; 123/198 D; 123/198 F

[51] Int. Cl.[2] ..... F02B 75/10

[58] Field of Search ..... 60/277, 285, 284, 274; 123/198 D, 198 DB, 198 F

[56] References Cited

UNITED STATES PATENTS

| | | | |
|---|---|---|---|
| 2,709,335 | 5/1955 | Vactor | 60/277 |
| 3,086,353 | 4/1963 | Ridgway | 60/285 |
| 3,172,251 | 3/1965 | Johnson | 60/277 |
| 3,263,413 | 8/1966 | Vactor | 60/277 |
| 3,301,245 | 1/1967 | Woodburn | 123/198 D |
| 3,696,618 | 10/1972 | Boyd | 60/276 |
| 3,738,108 | 6/1973 | Goto | 60/277 |

FOREIGN PATENTS OR APPLICATIONS

| | | | |
|---|---|---|---|
| 782,372 | 9/1957 | United Kingdom | 60/310 |

*Primary Examiner*—Douglas Hart
*Attorney, Agent, or Firm*—Ernest F. Marmorek

[57] ABSTRACT

In a motor vehicle having a combustion engine including combustion spaces, such as pistons, comprising fuel dosing device, an exhaust gas conduit system and an exhaust gas cleaning arrangement associated with the exhaust gas conduit system, a temperature sensor provided in the exhaust gas cleaning system for producing control signals when the temperature of the exhaust gas cleaning system exceeds a predetermined value, the control signals being fed to the operating devices of the fuel and/or air dosing devices for at least reducing the fuel supply to the combustion engine.

4 Claims, 1 Drawing Figure

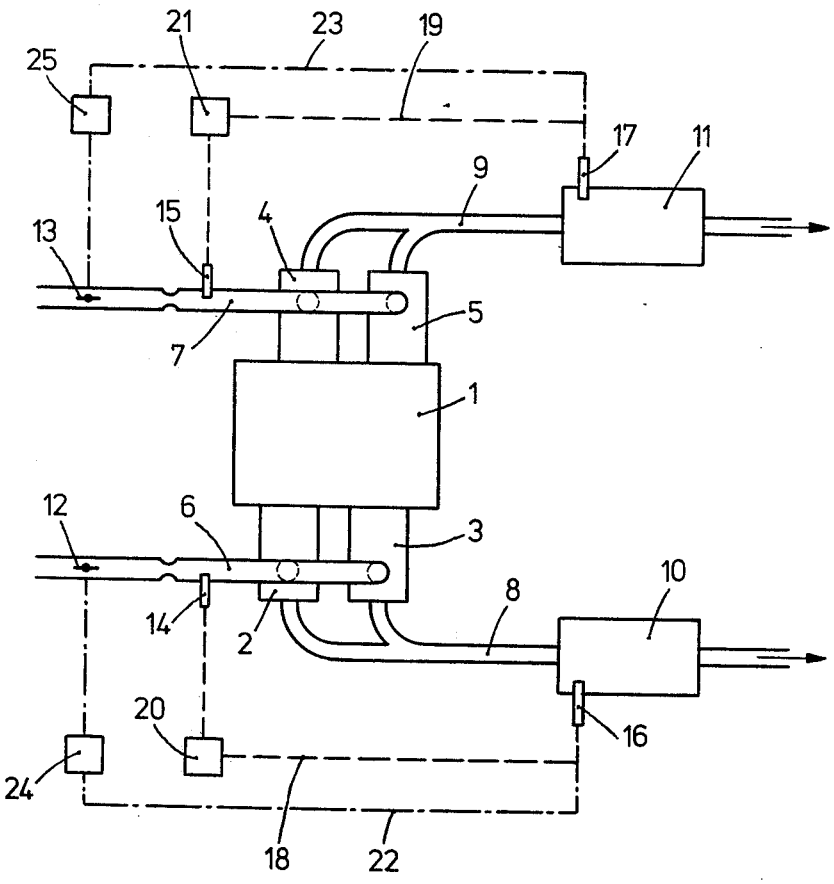
21
23
19
25
17
11
9
15
4
13
5
7
1
12
6
3
10
8
14
2
20
16
24
18
22

COMBUSTION ENGINE WITH AT LEAST ONE EXHAUST GAS CLEANING ARRANGEMENT

This is a continuation of application Ser. No. 262,006, filed June 12, 1972, now abandoned.

CROSS-REFERENCE TO OTHER APPLICATIONS

Reference should be had to the copending application of Herbert Heitland entitled Converter For Catalytic Exhaust Gas Cleaning and of the application of Herbert Heitland and Peter Manderscheid entitled Arrangement for Exhaust Gas Cleaning, both being filed concurrently and being assigned to the same assignee as the present application.

FIELD OF THE INVENTION

The present invention generally relates to a motor vehicle, and more particularly it relates to a motor vehicle having a combustion engine with combustion spaces, such as pistons, and which further includes a fuel distribution and measuring system, an exhaust gas system, an exhaust gas cleaning system having associated therewith a temperature sensor for producing control signals in the event very high temperatures are developed within the exhaust gas cleaning system.

BACKGROUND OF THE INVENTION

It is well known that catalytically or thermically operating exhaust gas cleaning arrangements in order that they could attain a high efficiency in their cleaning activity, are operated at high temperatures. It is, however, also known that a very high temperature may lead to an untimely destruction of the cleaning system. Extremely high and inadmissible temperatures in the exhaust gas usually occur when there is a failure in the ignition system, or there is an insufficient combustion of the gases within the combustion space or in the event there is an improper mixture formation within the combustion space and thereby the combustion takes partly place in the exhaust gas cleaning system instead of within the combustion space.

Attempts have been made to cure the abovementioned disadvantages and defects and one such attempt is represented by German Utility Model No. 1,917,133 - 46 c 6-6/61 which describes an arrangement having in its catalyzator a temperature sensor provided which, in the event very high and undesirable temperatures are present in the bed of the catalyzator will operate a valve which bypasses the exhaust gases about the catalyzator bed. As a result a destruction of the catalyzator bed by the extremely high exhaust gas temperature can be prevented, however, this is done only by disconnecting the exhaust gas cleaning system and thereby emitting the uncleaned exhaust gas into the atmosphere.

From German laid open application No. 1,921,024 a device for cleaning the exhaust gases is known as using a separately heated thermal reactor in which, in the event undesirably high temperatures are developed in the reactor, the fuel for its heating is disconnected. This means that the reactor in certain circumstances becomes inoperative and, the danger that it can be overheated by operating defects such as failure of the ignition etc., as mentioned above, is still present. In this device after the heating fuel to the reactor has been disconnected a chemical transformation of the exhaust gas components takes place at a positive heat generation.

SUMMARY OF THE INVENTION

It is, therefore, an object of the present invention to provide in a motor vehicle having a combustion engine an exhaust gas cleaning arrangement, wherein the untimely destruction or damage to the cleaning arrangement due to high temperatures is eliminated and, wherein the emission of the unclean gases to the atmosphere is not present.

According to the present invention the problems involving the exhaust gas cleaning system are solved by developing control signals in the cleaning system and feeding them through the fuel distribution system where, in response to certain control signals, the fuel fed to the combustion engine is at least reduced.

While the above described known devices in order to prevent the destruction of the exhaust gas cleaning arrangement in the event high temperatures are present are restricted to means effecting the components of the cleaning arrangement itself, the arrangement proposed according to the present invention, in the presence of high temperatures in the exhaust gas cleaning arrangement effect the reduction or even an interruption of the fuel supply to the combustion spaces of the vehicle. It is within the scope of the present invention that the combustion air supply is also simultaneously reduced to the combustion spaces or, in some cases, it is even interrupted. Only by the provision of an arrangement according to the present invention which effects the combustion engine itself can one attain that the defects causing the occurrence of the undesirably high temperature in the components of the exhaust gas cleaning arrangement, such as, delayed combustion of the charge in the combustion space, become eliminated and, there will be no danger that the advantages obtainable by the present invention are the result of a compromise, such as, emission of uncleaned exhaust gases as is the case in the known systems.

One could argue that the exhaust gas cleaning arrangement effecting the entire combustion engine according to the present invention may stall the vehicle at undesirably high temperatures in the exhaust gas cleaning system despite the fact that the combustion engine itself would be operational. Such argument can be countered by the fact that a modern combustion engine has not a single but a plurality of combustion spaces or cylinders and, the exhaust gas cleaning system according to the present invention is constructed in such a manner that to each combustion space or cylinder or to a combustion space or cylinder group a separate cleaning arrangement is provided in the individual exhaust gas conduits of that individual combustion space or cylinder or group along with an individual temperature sensor, the control signals of which are delivered to the fuel distribution system or member of that particular combustion space, or piston or group to control or disconnect only that piston or group only. As a result, it is attained that only that combustion space or cylinder or cylinder group becomes disconnected which has operated unsatisfactorily and, consequently, in its associated exhaust gas cleaning arrangement a high temperature has developed. The combustion engine can safely operate with the remaining cylinders. In case of a motor vehicle this means that the operator of the vehicle will have opportunity to reach the next shop in order that the disconnected combustion space or cylinder or disconnected combustion space or cylinder group could be fixed.

The means for performing the above described measures according to the present invention are constructed in a very simple manner. According to the present invention the same fuel supply and combustion air supply and distributing members can be used as heretofore. In the case the combustion engine has an outer mixture supply, the control signals developed by the sensors within the exhaust gas cleaning system can be fed to the engergizing means of a choke valve provided in the mixture supply conduit. It is noted that instead of having the temperature sensors of the exhaust gas cleaning system developing or producing the control signals directly one may pass such signals through a relay or amplifying system.

BRIEF DESCRIPTION OF THE DRAWING

The invention will become more readily apparent from the following description of a preferred embodiment thereof shown, by way of example, in the accompanying single FIGURE representing a schematic arrangement of the cleaning system in a vehicle.

DESCRIPTION OF THE PREFERRED EMBODIMENT

With reference to the single FIGURE it is noted that the combustion engine 1 is represented as an engine for a motor vehicle having four combustion spaces or cylinders. It is noted that the exhaust gas cleaning system proposed by the present invention is applicable as well to other types of combustion engines than the conventional piston-cylinder arrangement. The cylinders 2 and 3 as well as 4 and 5 lying, respectively, on opposite sides of the engine 1 form each a group to each of which a common fuel supply conduits 6 and 7 as well as a common exhaust gas conduits 8 and 9 are provided. In the exhaust gas conduits 8 and 9 a catalytic and/or thermically operable exhaust gas cleaning system 10 and 11 is provided as in the referenced applications.

In the suction or fuel supply conduits 6 and 7 a choke valve 12,13 is respectively provided which serves as the combustion air controlling device. Furthermore into such conduits 6 and 7 a fuel delivery and measuring device 14 and 15 is built in which usually constitutes components of a carburetor. As mentioned above, the present invention is applicable also to combustion engines having direct fuel injection or to those with indirect fuel injection.

In the exhaust gas cleaning systems 10 and 11 temperature sensors 16,17 is provided which, in the event very high undesirable temperature develops in the associated cleaning system, will generate control signals which through conductors 18 and 19 are fed to the energizing or operating means 20 and 21 controlling the fuel supply. In the schematic illustration of the single FIGURE the control signals from sensors 16 and 17 can be supplied over conductors 22 and 23 also to the energizing or operating means 24 and 25 of the respective choke valves 12 and 13 for effecting same in the event high temperatures are developed by reducing or disconnecting the fuel or air supply to the combustion engine. During operation, if undesirably high temperatures develop in any one of the indicated exhaust gas cleaning system 10 or 11 then the control signals developed by the sensors 16,17 will reduce, or, in extreme situation will disconnect completely the fuel supply and/or air supply to that particular cylinder or group of cylinders by effecting the energizing and operating means 20 or 24 of the fuel distribution or dosing device 14,15 and of the choke valves 12 or 13.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. In a motor vehicle having a combustion engine including groups of combustion spaces, fuel and combustion air dosing means for each of said groups of combustion spaces, means operating said dosing means, an exhaust gas conduit system and a thermally or catalytically operable exhaust gas cleaning arrangement associated with said exhaust gas conduit system, the improvement comprising the combination of a temperature sensing means provided in said exhaust gas cleaning arrangement for producing control signals when the temperature of the exhaust gas cleaning system exceeds a predetermined value, means feeding said control signals to the operating means of said fuel dosing means for at least reducing the fuel supply to the combustion engine, said operating means also being adapted to disconnect the fuel supply in response to said control signals, wherein said combustion engine comprises a first group of combustion spaces and a second group of combustion spaces, each of said groups having a separate exhaust gas conduit means having an exhaust gas cleaning arrangement placed therein, a temperature sensor provided in each of said exhaust gas cleaning systems for developing a control signal for controlling the operating means of said fuel dosing means and said combustion air dosing means of one of said groups independently of the other of said groups of combustion spaces.

2. In a motor vehicle having a combustion engine comprising a plurality of combustion spaces, a combination of fuel and air dosing means for supplying a combustible mixture to the combustion spaces, an exhaust gas conduit system and a thermally or catalytically operable exhaust gas cleaning arrangement associated with said exhaust gas conduit system, means for preventing overheating of said exhaust gas cleaning arrangement as a function of the temperature thereof, the improvement comprising the combination of temperature sensing means in the exhaust gas cleaning system for producing control signals when the temperature in the exhaust gas cleaning arrangement exceeds a predetermined value and operating means cooperating with the dosing means, said operating means being responsive to the control signals for at least reducing the output of at least one of the dosing means for at least the combustion spaces causing the excessive temperature in the exhaust gas cleaning system whereby the effectiveness of the selected combustion space is reduced while permitting the normal operation of the remaining combustion spaces to thereby lower the total effective output of the combustion engine as well as the temperature in the exhaust gas cleaning arrangement, said operating means cooperating with said fuel dosing means also being adapted to disconnect the fuel supply in response to a requisite control signal, wherein the combustion engine is defined by a first group of combustion spaces and a second group of combustion spaces, each of the groups having a separate combustion air supply and fuel dosing means and a separate exhaust gas conduit means having an exhaust gas cleaning arrangement placed therein and further comprising a temperature sensor provided in each of the exhaust gas cleaning systems for developing a control signal for controlling said operating means of said fuel dosing means and said combustion air dosing means of one of said groups independently of the other group of combustion spaces.

3. An exhaust gas purification system for a combustion engine having at least two combustion spaces, first control means which meters out variable amounts of fuel fluid and has at least two first control devices each associated with one of said combustion spaces, second control means which meters out variable amounts of a combustion-supporting fluid and has at least two second control devices each also associated with one of said combustion spaces, comprising exhaust gas purifying means adapted to receive and purify exhaust gases which originate in said engine, including at least two purifying devices each adapted to receive and purify combustion gases from one of said combustion spaces;

temperature sensing means for sensing the temperature of said purifying means and for producing a signal indicative of the sensed temperature exceeding a predetermined safe limit, including at least two sensors each associated with one of said purifying devices; and applying means for applying said signal to at least one of said control means to operate the same and effect at least a reduction in the metered amount of fluid controlled by said one control means, including at least two sets of signal conductors each connecting one of said sensors to at least one of said first and second control devices associated with each of said combustion spaces, whereby said purifying means is protected against damage due to heating beyond said safe limit as a result of the reduction in the exhaust gases being produced by said engine, while remaining operational and without requiring venting of unpurified exhaust gases directly into the atmosphere.

4. An exhaust gas purification system for a combustion engine having at least two groups of combustion spaces, first control means which meters out variable amounts of fuel fluid and has at least two first control devices each associated with one of said groups, second control means which meters out variable amounts of combustion-supporting fluid and has at least two second control devices each also associated with one of said groups, comprising exhaust gas purifying means adapted to receive and purify exhaust gases which originate in said engine, including at least two purifying devices each adapted to receive and purify combustion gases from one of said groups;

temperature sensing means and for sensing the temperature of said purifying means and for producing a signal indicative of the sensed temperature exceeding a predetermined safe limit, including at least two sensors each associated with one of said purifying devices; and applying means for applying said signal to at least one of said control means to operate the same and effect at least a reduction in the metered amount of fluid controlled by said one control means, including at least two sets of signal conductors each connecting one of said sensors to at least one of said first and second control devices associated with each of said groups, whereby said purifying means is protected against damage due to heating beyond said safe limit as a result of the reduction in the exhaust gases being produced by said engine, while remaining operational and without requiring venting of unpurified exhaust gases directly into the atmosphere.

* * * * *